US005177923A

United States Patent [19]

Nemchock

[11] Patent Number: 5,177,923

[45] Date of Patent: Jan. 12, 1993

[54] CEILING LOUVER ASSEMBLY

[75] Inventor: Gary Nemchock, Lawrence, Kans.

[73] Assignee: Architectural Forms, Inc., Lawrence, Kans.

[21] Appl. No.: 596,443

[22] Filed: Oct. 12, 1990

[51] Int. Cl.[5] ..... E04B 9/28; E04B 9/34

[52] U.S. Cl. ..... 52/489; 52/473; 52/666; 52/713

[58] Field of Search ..... 52/473, 489, 668, 664, 52/665, 666, 667, 484, 763, 713, 715, 486; 403/347

[56] References Cited

U.S. PATENT DOCUMENTS

| | | | |
|---|---|---|---|
| 3,463,432 | 8/1969 | Ptak | 52/489 X |
| 4,004,390 | 1/1977 | Mekwitz | 52/488 |
| 4,463,536 | 8/1984 | Anderle et al. | 52/473 X |
| 4,633,635 | 1/1987 | Anderson | 52/489 |

FOREIGN PATENT DOCUMENTS 51-16579 2/1976 Japan .

*Primary Examiner*—David A. Scherbel
*Assistant Examiner*—Kien T. Nguyen
*Attorney, Agent, or Firm*—Sughrue, Mion, Zinn, Macpeak & Seas

[57] ABSTRACT

A ceiling louver assembly is constructed from a plurality of ceiling units each having four ceiling tiles with each ceiling tile having identical projecting side tabs disposed in coplanar abutting relation with side tabs of adjacent tiles. A metal strap is disposed in overlying relation with respect to the coplanar abutting side tabs of adjacent tiles and secured thereto by means of screws in blind bores. Each ceiling tile is provided with a projecting corner tab at each corner and a hanger is disposed in engagement with the four projecting corner tabs of four adjacent units. The hanger is comprised of a base plate underlying the corner tabs with upstanding flanges disposed between adjacent units to prevent lateral movement of the corner tabs relative to each other. A vertically extending eye bolt is secured to the base plate for suspending the hanger from a support structure and a flexible gasket is secured about the eye bolt between the eye thereof and the corner tabs to prevent vertical movement of the corner tabs relative to the flanges.

4 Claims, 3 Drawing Sheets

CEILING LOUVER ASSEMBLY

BACKGROUND OF THE INVENTION

The present invention is directed to a custom ceiling louver assembly comprised of four cellular die-cast aluminum ceiling tiles interconnected along adjacent sides to define a ceiling unit with a plurality of ceiling units being interconnected and suspended by means of a hanger assembly engaging complementary projecting tab portions at the adjacent corners of four contiguous units, and more specifically, to the specific hanger assemblies and connecting means for adjacent tiles.

A similar ceiling louver assembly is disclosed in Japanese patent 51-16579 granted May 4, 1976. In the ceiling louver assembly disclosed in this Japanese patent, four individual die-cast aluminum square ceiling tiles are provided having a plurality of cell-like interconnected members. The alternate edges of the individual square tiles are provided with complementary overlapping configurations which may be interconnected by screw members. The larger composite tile assembly is supported at each junction of four adjacent tiles by means of a hanger comprised of a substantially square support plate underlying projecting corner tabs on each tile. Each support plate is provided with four upstanding flanges, each extending between adjacent ceiling tiles to hold the projecting corner tabs of each tile in superimposed relation on the support plate. The center of the support plate is provided with a threaded aperture and a threaded bolt is engaged therein which extends vertically upwardly for connection to a suitable support structure above the ceiling tiles from which the ceiling tiles will be suspended.

Due to the fact that the projecting tabs along each side of the ceiling tiles are designed to have an overlapping complementary configuration, the projecting tabs are relatively thin and are therefore readily broken in handling prior to assembly and during the assembly process due to the stresses imparted thereto by the threaded connecting member. Structural integrity of the joint condition is subject to failure. While the upwardly projecting flanges on the support plate located at the intersection of four tiles restrain the tiles from lateral movement relative to each other, there is nothing to prevent the tiles from being raised upwardly above the flanges. Furthermore, since a hanger is required at the intersection of each set of four tiles, an extremely large number of hangers will be required.

SUMMARY OF THE INVENTION

The present invention provides a new and improved ceiling louver assembly which overcomes all of the aforementioned problems associated with the prior art construction.

The present invention provides a new and improved ceiling louver assembly comprised of a plurality of ceiling units each comprised of four ceiling tiles, two complimentary pairs having projecting side tabs disposed in coplanar abutting relation with side tabs of adjacent tiles, strap means overlying said side tabs of adjacent tiles and means securing said strap means to said side tabs to provide the sole engagement for said four ceiling tiles of each ceiling unit, each ceiling tile having three substantially square-shaped projecting corner tabs and a single triangular-shaped projecting corner tab which are located at the four corners of each composite ceiling unit, hanger means engaged with four triangular-shaped projecting corner tabs of four adjacent units and having retainer means to prevent lateral and vertical displacement of said adjacent units relative to each other.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
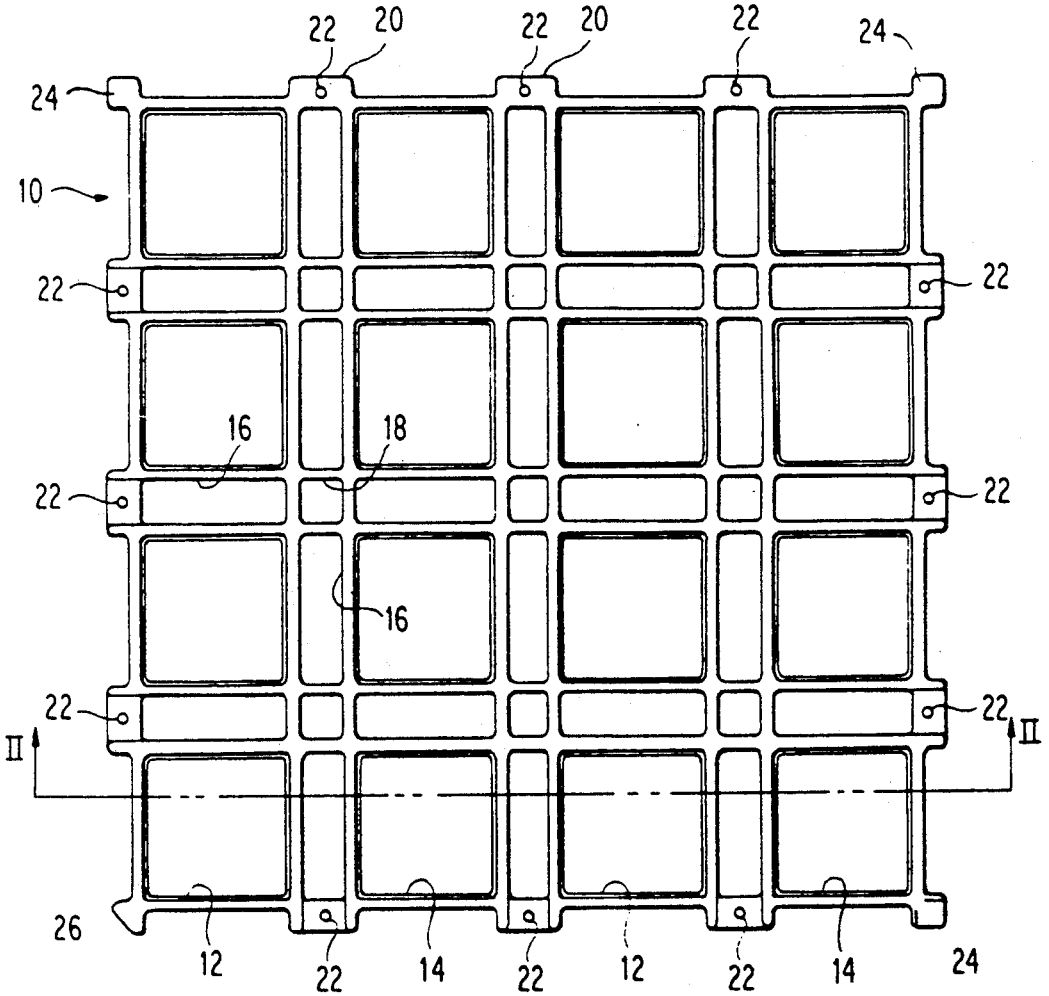
FIG. 1 is a plan view of a Ceiling tile according to the present invention.
Figure 2:
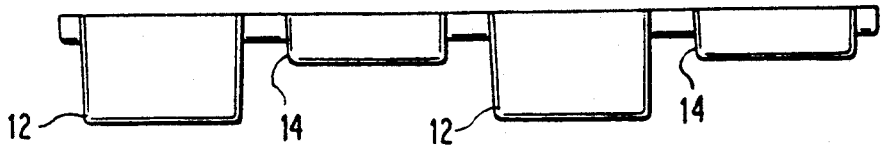
FIG. 2 is a sectional view taken along the lines II—II of FIG. 1.

The ceiling louver system according to the present invention is comprised of a plurality of interconnected ceiling tiles identical to the ceiling tile 10 shown in FIG. 1. Each ceiling tile 10 is comprised of a die-cast aluminum grid having a plurality of cell-like interconnected members 12 and 14 of varying height which may be open or closed. As shown in FIG. 2, the cell-like members 12 and 14 are all open as are the rectangular cell-like members 16 located along the sides of the larger cells 12 and 14. The square cell-like like members 18 formed at the intersection of the rectangular cell-like members 16 are preferably closed. However, the varying heights of the members as well as whether the members are opened or closed, can readily be varied within the scope of the present invention since these features are primarily design features.

Along the sides of the ceiling tile 10 are a plurality of side tabs 20 which are located at the ends of the cell-like members 16 and protrude beyond the sides of adjacent cell-like members 12 and 14. Each tab 20 has a threaded blind aperture 22 centered thereon on the upper side, as viewed in FIG. 1. Three corners of the tile 10 are provided with square shaped protruding corner tabs 24 while the fourth corner of the tile 10 is provided with a corner tab 26 having a substantially triangular configuration. None of the corner tabs are provided with threaded blind apertures.

Figure 3:
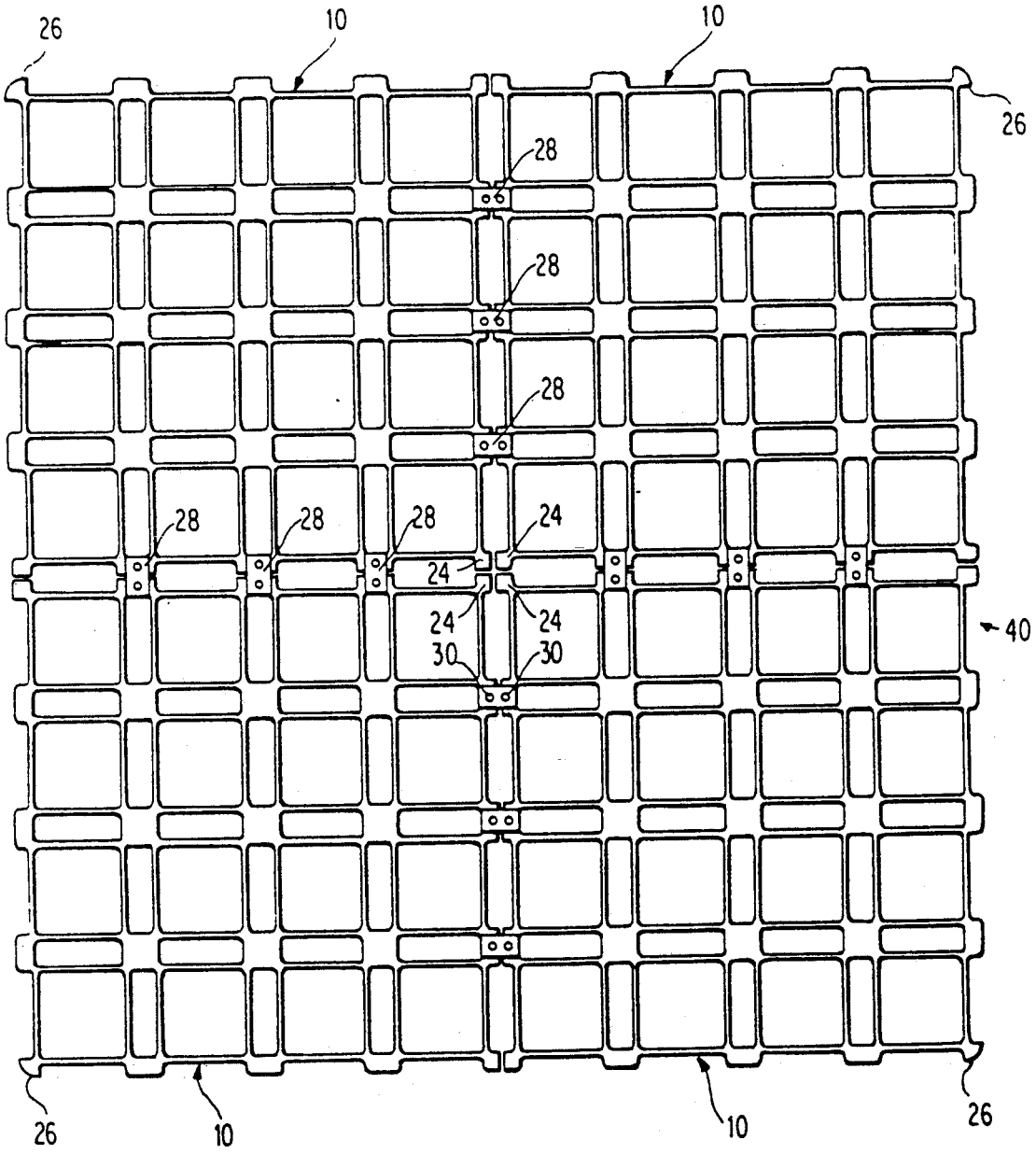
FIG. 3 is a plan view of four interconnected tiles as shown in FIG. 1 to define a ceiling unit.

As illustrated in FIG. 3, two complimentary pairs of ceiling tiles 10 are interconnected to form a ceiling unit of the ceiling louver system. The four tiles 10 are disposed in a common plane in side by side relation with the side tabs 10 being disposed in closely spaced apart proximity to each other. The triangular corner tabs 26 of each tile are disposed at the four corners of the unit. In the center of the unit, four square corner tabs 24 are disposed adjacent each other. A plurality of rectangular connector strips 28 overlap adjacent side tabs 20. Each connector strip 28 has two spaced apart holes which will be aligned with the threaded blind holes in the side tabs 28 and screw members 30 are threaded into the holes (not shown) to secure the adjacent tiles 10 together by means of the connector strips 28. The holes into which the screws 30 are threaded do not necessarily have to be threaded holes, but could be smooth, blind bores and the screws 30 could be self-tapping screws. The square shaped corner tabs which are disposed in close proximity to each other ar not interconnected by means of connector strips 28 but are left unconnected to each other.

Figure 4:
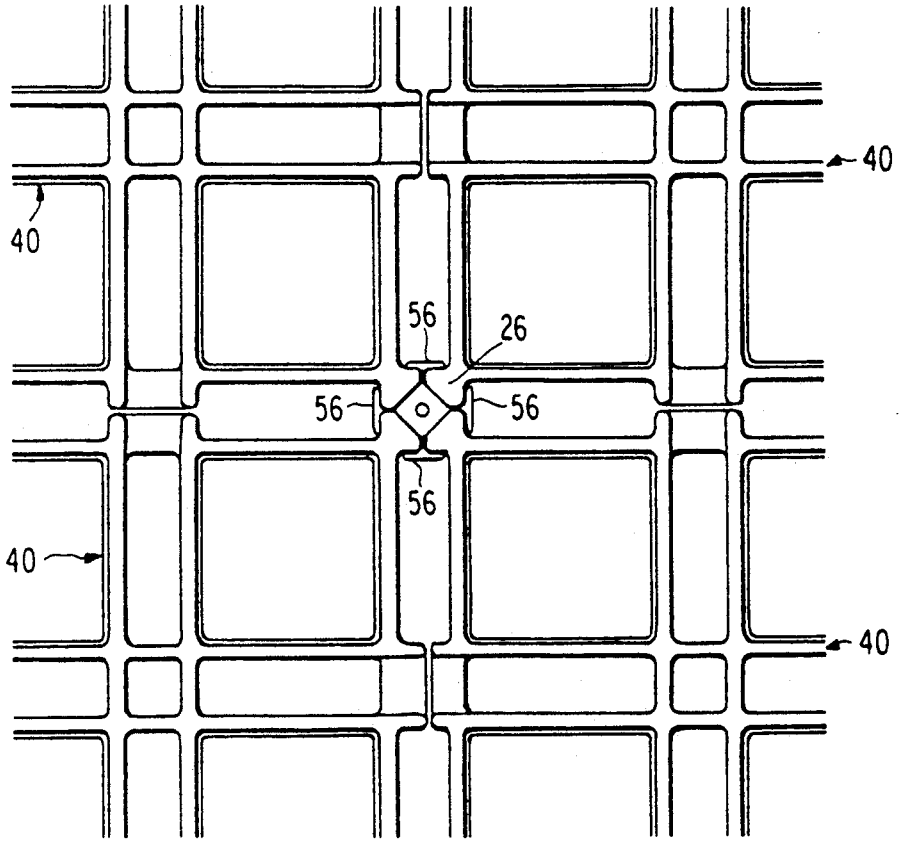
FIG. 4 is a plan view showing portions of four adjacent ceiling units of the type shown in FIG. 3 in engagement with a hanger.
Figure 5:
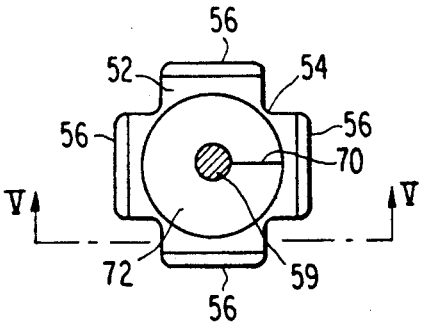
FIG. 5 is a sectional view of a hanger and gasket assembly taken along the line V—V in FIG. 6.
Figure 6:
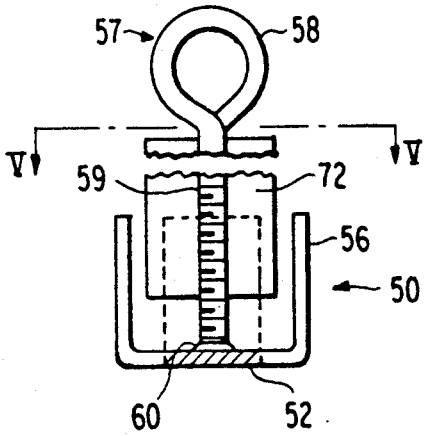
FIG. 6 is a sectional view taken along the line VI—VI in FIG. 5.

Once a plurality of ceiling tile units 40 as shown in FIG. 3 are assembled, the ceiling tile units are then suspended from a suitable support structure adjacent each other in a common plane. Corner portions of four adjacent ceiling tile units 40 are illustrated in FIG. 4 for the purpose of illustrating how the ceiling tile units 40 are interconnected to each other by means of a hanger assembly which is also used to hang a composite ceiling louver assembly from a support structure. The hanger assembly 50 is illustrated in detail in FIGS. 5 and 6 and is comprised of a base support plate 52 having a substantially square shaped configuration with cut-out corner portions 54. Four vertically extending retainer flanges 56 are of integral one piece construction with the base support plate 52 but have been bent upwardly as shown in FIG. 6 so that the four retainer flanges 56 are spaced from each other. A threaded eye bolt 57 having a head portion 58 and a shank portion 59 is stud welded to the upper surface of the support plate 52 by means of a suitable weld 60. The eye bolt 58 and the retainer 52, 56 are all constructed of steel or the like. The four ceiling units 40 as shown in FIG. 4, are interconnected with the hanger assembly 50 by placing the triangular corner tab 26 of each ceiling unit 40 over the top of two adjacent flanges 56 and lowering the corner tab 26 into engagement with the support plate 52 of the hanger assembly. Thus, the four ceiling tile units have their triangular corner tabs 26 secured in the retainer assembly 50 and are restrained against any lateral movement relative to each other by the vertically extending flanges 56 as best seen in FIG. 4. In order to prevent vertical movement of the triangular tabs 26 relative to the hanger assembly 50 once the four ceiling tile units 40 have been assembled together, a hollow cylindrical split gasket 72 having a radial slit 70 extending the length thereof, is fitted over the shank of the eye bolt into engagement with the upper surfaces of the triangular corner tabs 26 of the tile units 40. The gasket 72 has a length sufficient so as to extend substantially between the eye portion of the eye bolt 58 and the upper surface of the corner tabs 26 thereby making it impossible to raise the corner tabs 26 above the tops of the flanges 56 to prevent disengagement of the ceiling tile units 40 from the hanger assemblies 50. The gaskets may be made of any suitable material, such as rubber, a flexible polymer or the like. While the eye bolt 58 has been illustrated as having a threaded shank, it is not absolutely essential for the shank to be threaded. The eye bolts 58 may be suspended from a suitable support structure (not shown) by any suitable means which are conventional in the art.

While the invention has been particularly shown and described with reference to preferred embodiments thereof, it will be understood by those in the art that the foregoing and other changes in form and details may be made therein without departing from the spirit and scope of the invention.

What is claimed is:

1. A ceiling louver assembly comprised of four substantially square ceiling louver means disposed adjacent to each other in a common plane, each ceiling louver means having a projecting corner tab disposed adjacent each other and hanger means comprised of an imperforate support plate underlying said four corner tabs and having upwardly extending flanges between each two adjacent ceiling louver means in engagement with said corner tabs thereof, a vertically extending hanger member having a head portion and a shank portion secured to said support plate and extending upwardly between said corner tabs and gasket means detachably connected to said shank portions between said head portion and said corner tabs to prevent vertical movement of said ceiling louver means relative to said hanger means.

2. A ceiling louver assembly as set forth in claim 1 wherein each ceiling louver means is comprised of four ceiling tiles of die-cast aluminum disposed in side by side coplanar relation, each ceiling tile having a plurality of spaced apart projecting side tabs disposed in adjacent coplanar relationship with corresponding projecting side tabs on adjacent ceiling tiles, strap means overlying adjacent side tabs of adjacent ceiling tiles and screw means connecting said strap means to said tabs.

3. A ceiling tile assembly as set forth in claim 2, wherein said ceiling tiles each have a projecting corner tab disposed adjacent each other in coplanar, unconnected relation to each other.

4. A ceiling louver assembly comprising four ceiling tiles disposed in side by side coplanar relation, each ceiling tile having a plurality of identical spaced apart projecting side tabs disposed in adjacent coplanar relationship with corresponding projecting side tabs on adjacent ceiling tiles, strap means overlying adjacent side tabs of adjacent ceiling tiles and screw means connecting said strap means to said tabs.

* * * * *